United States Patent [19]

Thornthwaite

[11] Patent Number: 4,802,453

[45] Date of Patent: Feb. 7, 1989

[54] FUEL INJECTION PUMP

[75] Inventor: Ian R. Thornthwaite, Gillingham, England

[73] Assignee: Lucas Industries Public Limited Company, Birmingham, England

[21] Appl. No.: 77,809

[22] Filed: Jul. 27, 1987

[30] Foreign Application Priority Data

Aug. 16, 1986 [GB] United Kingdom ..... 8619994

[51] Int. Cl.[4] ..... F02M 41/14; F02M 37/06; F04B 29/00

[52] U.S. Cl. ..... 123/450; 123/502; 417/221

[58] Field of Search ..... 417/221; 123/450, 502

[56] References Cited

U.S. PATENT DOCUMENTS

| | | | |
|---|---|---|---|
| 3,051,154 | 8/1962 | Kemp | 123/502 |
| 3,439,624 | 4/1969 | Glikin et al. | 123/450 |
| 3,447,520 | 6/1969 | Drori | 123/450 |
| 3,897,764 | 8/1975 | Bakti | 123/502 |
| 4,037,573 | 7/1977 | Swift | 417/221 |
| 4,074,667 | 2/1978 | Skinner | 123/502 |
| 4,610,234 | 9/1986 | Sakuranaka | 123/502 |

FOREIGN PATENT DOCUMENTS

| | | | |
|---|---|---|---|
| 3345841 | 6/1985 | Fed. Rep. of Germany | 123/502 |

*Primary Examiner*—William L. Freeh

*Attorney, Agent, or Firm*—Balogh, Osann, Kramer, Dvorak, Genova & Traub

[57] ABSTRACT

A fuel injection pump of the rotary distributor type has a fluid pressure operable piston connected to a cam ring of the pump for the purpose of timing adjustment. Flow of fluid into or out of one end of the cylinder containing the piston is controlled by a valve member slidable in a bore in the piston. The valve member is pressure balanced and is positioned by means of control pistons in response to variation in fluid pressure. The piston is subject to reaction forces when the cam followeres of the pump engage the leading faces of the cam lobes and the tendency for piston movement is resisted by a ball valve. Opposite reaction forces occur when the cam followers move over the crests of the cam lobes and piston movement is resisted by restricting liquid flow from the other end of the cylinder.

12 Claims, 3 Drawing Sheets

FUEL INJECTION PUMP

This invention relates to a liquid fuel injection pump for supplying fuel to an internal combustion engine and of the kind comprising a pumping plunger located in a bore, cam means and cam follower means, a drive shaft coupled to one of said means for driving the cam means and cam follower means relative to each other to impart inward movement to the plunger and a fluid pressure operable device for effecting limited movement of the other of said means about the axis of rotation of the drive shaft.

Figure 1:
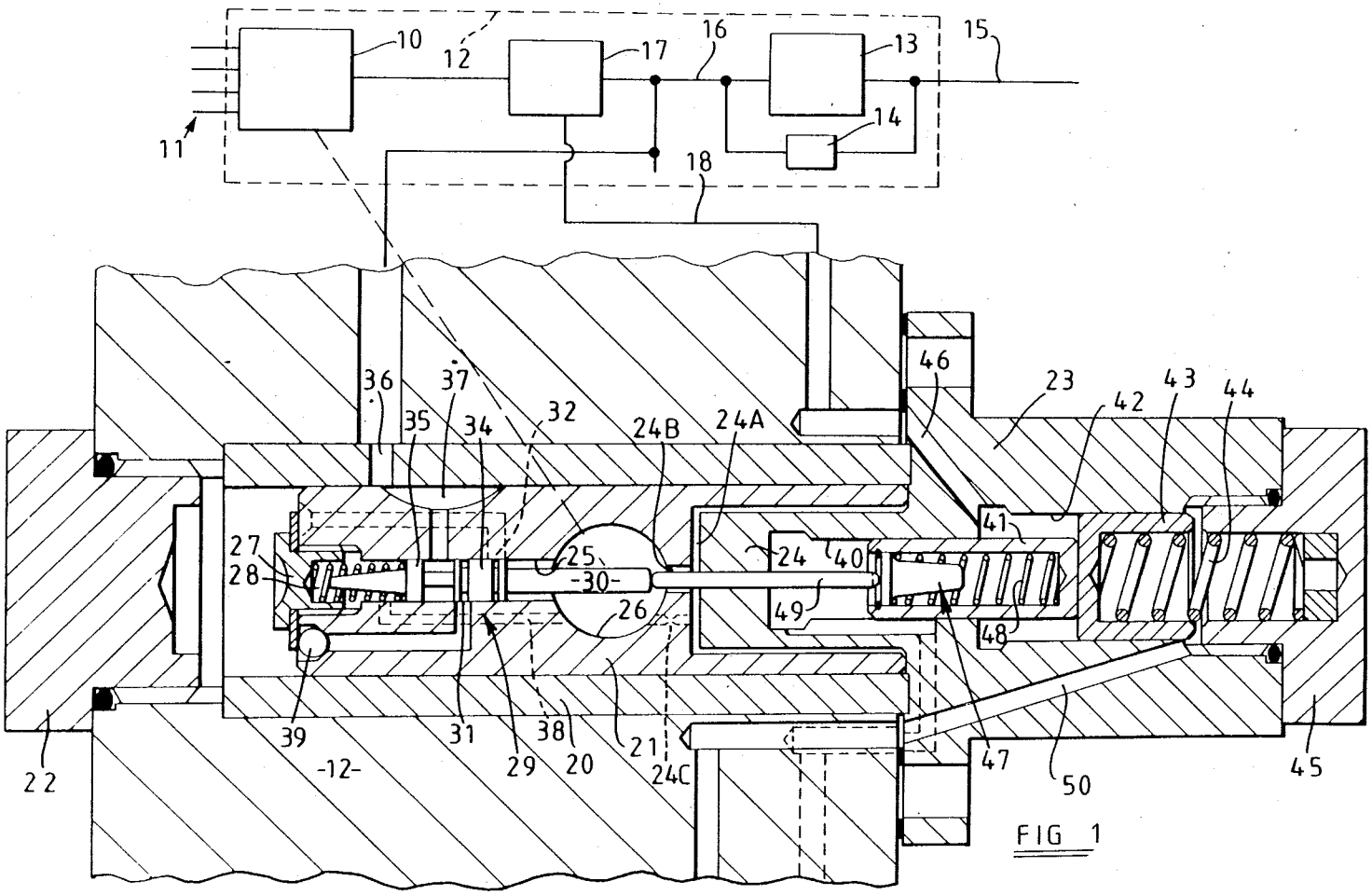

An example of such a pump is shown in FIG. 1 of U.S. Pat. No. 4,520,782 being a rotary distributor type fuel injection pump in which the drive shaft is coupled to a rotary distributor member which carries the pump plunger or plungers in a transverse bore. The cam follower means is rotatable with the distributor member and the cam means comprises an annular cam ring having cam lobes on its internal peripheral surface. The fluid pressure operable device comprises a piston which is coupled to the cam ring in such a manner that the cam ring can be moved angularly about the axis of rotation of the distributor member and drive shaft to enable the timing of fuel delivery by the pump to be varied.

Such pumps also incorporate a low pressure fuel pump which besides serving as a source of fuel under pressure for application to the piston, also serves to supply fuel to the bore containing the plunger. The amount of fuel which is supplied to the bore is controlled by a fuel control device which may comprise a simple throttle.

It is known to control the output pressure of the low pressure pump so that it varies in accordance with the speed and to apply the pressure directly to a resiliently loaded valve member mounted in a bore in the piston and which in conjunction with suitable ports, controls the flow of fuel into or out of the cylinder containing the piston.

The valve member in response to an increase in the output pressure will move relative to the piston to allow fuel to enter the cylinder and the piston will then move to follow the movement of the valve member until a new equilibrium position is established. Such movement of the piston will advance the timing of fuel delivery. Conversely if the pressure falls the valve member and piston will move in the opposite direction to retard the timing of fuel delivery. The piston in use is subject to the reaction forces on the cam ring caused by the engagement of the cam followers with the cam lobes. When the cam followers strike the leading faces of the cam lobes the reaction force tends to compress the fuel in the cylinder. Movement of the piston in this situation can be minimised by the provision of a ball check valve in the passage through which fuel is introduced into the cylinder under the control of the valve member. When the followers move over the crests of the cam lobes the reaction is in the opposite direction and the reaction forces can be sufficiently high to cause movement of the piston. Such movement of the piston can induce a number of undesirable effects the main one being that the piston assumes an incorrect position when the followers once again engage the leading faces of the cam lobes. This situation is undesirable.

The object of the invention is to provide a pump of the kind specified in a simple and convenient form.

According to one aspect of the invention in a pump of the kind specified said fluid pressure operable device comprises a piston slidable within a cylinder, means coupling the piston to the other of said means, a control valve member slidable within a bore defined in the piston, passage means through which the opposite ends of said control valve member are exposed to a low pressure, port means opening into said bore and controlled by the valve member whereby when the valve member is moved in one direction fluid can flow to one end of the cylinder to move the piston in the same direction to re-establish an equilibrium position and when the valve member is moved in the other direction fluid can flow out of said one end of the cylinder to allow the piston to move in the other direction until the equilibrium position is re-established, and means responsive to a control pressure for controlling the position of said valve member.

According to another aspect of the invention said fluid pressure operable device comprises a piston slidable within a cylinder, a control valve member slidable within a bore formed in the piston and movable in response to a change in an operating parameter of the associated engine to allow the admission of or the escape of liquid from one end of the cylinder and means for damping the movement of the piston away from said one end of the cylinder.

Examples of fuel injection pump in accordance with the invention will now be described with reference to the accompanying drawings FIG. 1 of which shows a part of the pump in block form, the remaining part of the pump being shown in sectional side elevation, FIG. 2 of which shows a modification of the pump shown in FIG. 1 also in sectional side elevation and FIG. 3 of which shows in sectional side elevation a part of the pump shown in block form in FIG. 1.

Figure 3:
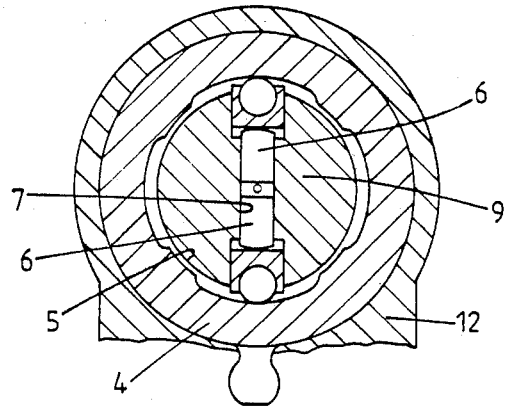

The fuel injection pump as shown in FIG. 3, is of the rotary distributor type in which a distributor member 9 is journalled within a body part 12 and is provided with a transversely extending bore 7 which contains a pair of pumping plungers 6. The plungers are arranged to be moved inwardly to displace fuel from the bore by cam lobes 5 formed on the internal peripheral surface of an annular cam ring 4, the distributor member being coupled to a drive shaft which in use is driven in timed relationship with an associated engine. Fuel displaced by the inward movement of the plungers is delivered to a plurality of outlet ports in turn and fuel is supplied to the bore during the filling periods thereof. This portion of the pump, which can be regarded as a high pressure pump, is indicated at 10 in FIG. 1 with the outlets being indicated at 11. The body part of the pump is indicated at 12 and located within the body part is a low pressure pump 13 which draws fuel through an inlet 15 and supplies fuel through an outlet 16 which is connected to the inlet of the high pressure pump 10 by way of a fuel control device indicated at 17. The outlet pressure of the low pressure pump 13 is controlled by a relief valve 14 so that the outlet pressure varies in accordance with the speed at which the pump is driven.

The fuel control device 17 may take the form of a throttle or it may be some other more complex form of device but whichever form it takes, it is arranged to produce in a pipeline 18, fuel at a pressure which varies inversely with the amount of fuel which is being supplied to the associated engine that is to say the pressure increases towards the outlet pressure of the low pressure pump as the amount of fuel which is supplied to the associated engine decreases.

Turning now to the sectioned portion of the drawing the body part 12 houses a sleeve 20 in which is slidably mounted a piston 21. The piston 21 is mechanically coupled to the aforesaid cam ring in known manner and one end of the cylinder defined by the sleeve is closed by a simple plug 22 whilst the other end of the cylinder is closed by an end closure 23 which is detachably secured to the body part 12 and which has a cylindrical portion 24 of lesser diameter than the cylinder, projecting into the cylinder. Moreover, the piston 21 is recessed and the cylindrical portion 24 extends into the recess to define a space 24A.

Formed in the piston is a bore 25 which extends from a central opening 26 in which is located a peg 8 coupled to the cam ring, to the end of the piston nearer to the plug 22. This end of the bore is closed by a screwed plug 27 which serves as an abutment for one end of a light coiled compression spring 28 the other end of which is engaged with a valve member generally indicated at 29, slidable within the bore 25. The valve member is provided with an extension 30 which extends partly across the opening for a purpose to be described.

The valve member 29 controls the admission of fluid under pressure into the end of the cylinder defined between the piston and the plug 22 and it also controls the escape of fluid from the cylinder. For this purpose a pair of ports 31, 32 open into the bore 25 at axially spaced positions. Both ports are connected by drillings respectively with the end of the cylinder adjacent the plug 22 and the valve member is provided with a land 34 which in the equilibrium position as shown, covers the ports 31 and 32. The valve member defines a further land 35 which is spaced from the land 34 to define a groove to which fuel under pressure from the outlet 16 of the low pressure pump 13 is constantly supplied, this being achieved by a port 36 in the sleeve and a cooperating groove 37 formed in the piston. The end of the valve member from which extends the extension 30 is exposed to the pressure within the body part 12 and it is arranged that the opposite end of the valve member is also subjected to this pressure by providing a passage 38 in the piston and which extends to the opening 26. By this arrangement the ends of the valve member are exposed to the same low pressure and the presented faces of the lands 34, 35 are exposed to the same higher pressure so that the valve member can be regarded for practical purposes, as being pressure balanced.

With the arrangement as described, movement of the valve member towards the left as seen in the drawings, will expose the port 32 to permit fuel to escape from the cylinder thereby allowing movement of the piston towards the left as seen in the drawing until an equilibrium position is established with the ports 31 and 32 being covered by the land 34. If the valve member is moved towards the right then the port 31 is uncovered to the groove in the valve member and fuel can flow into the one end of the cylinder to move the piston towards the right until the equilibrium position is again established. It will thus be seen that the piston will follow the movement of the valve member. The piston 21 since it is connected to the cam ring is subject to the reaction forces generated by the action of the followers with the cam lobes and the normal cam reaction when the followers engage the cam lobes will be to urge the piston towards the left and it is this reaction which causes movement of the piston when the valve member is moved towards the left. The cam reaction would normally displace the piston to the left relative to the valve member and such movement would tend to open the port 31 so that pressurised fuel in the end of the cylinder could be forced back towards the outlet of the low pressure pump. Such flow of fuel is prevented by the action of a ball check valve indicated at 39. When the followers ride over the cam lobes the reaction force is in the opposite direction tending to move the piston to the right. The result is that the movement of the piston is no longer restrained.

Formed in the end closure 23 is a stepped bore in the narrower and inner part 40 of which is slidable a first control piston 41. The piston 41 extends into a wider part 42 of the bore in which is located a second control piston 43 and the latter is biased in a direction towards the piston 21 by the action of a coiled compression spring 44 which bears against a closure plug 45. The inner portion of the part 42 of the bore is connected by way of a passage 46, with the aforesaid pipeline 18 and the inner portion of the part 40 of the bore is connected to the outlet 16 of the low pressure pump.

The piston 41 is of cup-shaped form having its open end directed towards the piston 21 and located within the piston 41 is an abutment member 47 which is biased by a spring 48 located within the piston into engagement with a circlip or similar retaining member in the open end of the piston. The abutment 47 is engaged by a pin 49 which extends through a drilling in the cylindrical portion 24 and into engagement with the extension 30 of the valve member 29. The portion of the pin 49 which passes through the piston 21 does so with a clearance 24B which forms a restricted flow path into the space 24A between the cylindrical portion 24 and the piston 21 the restricted flow of fuel from the space 24A through the clearance 24B acting to damp the movement of the piston in particular when the piston is urged towards the right after the followers have ridden over the cam lobes. Finally the space between the piston 43 and the plug 45 communicates by way of a passage 50 with the interior of the body part.

In operation, and considering firstly the action of the piston 41, this is subject to the outlet pressure of the low pressure pump 13 and moves under the action of this pressure against the action of the spring 44. Such movement allows the spring 28 to urge the valve member towards the right and as previously described, this will permit fuel to flow into the cylinder to cause movement of the piston 21 towards the right. It should be noted that in the drawing the piston is already in its extreme right hand position. As the output pressure of the low pressure pump falls, the piston 41 will move to the left under the action of the spring 44 and this will cause displacement of the valve member towards the left thereby allowing the piston 21 to move towards the left. The setting of the piston 21 therefore varies in accordance with the outlet pressure of the low pressure pump which as previously stated, varies in accordance with the speed.

The timing of fuel delivery in a distributor pump of the type described varies with the amount of fuel which is being supplied to the associated engine and as the quantity of fuel delivered reduces, the timing of the start of fuel delivery becomes later. It is therefore desirable, to be able to move the cam ring to at least maintain the timing of delivery of fuel and this is achieved by use of the piston 43 which is subjected to the pressure in the pipe line 18. This pressure increases as the quantity of fuel decreases and the practical effect is that with a reduction in the quantity of fuel, the piston 43 will move along with the piston 41, against the action of the spring 44 to move the cam ring in the direction to advance the timing of fuel delivery.

As explained the movement of the piston 21 is damped by the fact that fuel has to flow into and out of the damping chamber defined by the space 24A between the piston and the cylindrical portion 24 through the aforesaid clearance 24B. However, when the pump is assembled there will be little if any fuel in the damping chamber or in the remaining passages so that the damping action will not be provided and the movement of the piston 21 will not be controlled. The purpose of the spring 48 which normally takes no part in the operation of the pump, is to allow movement of the abutment 47 in this situation thereby to minimise the compressive stress applied to the thin rod 49.

As an alternative to the clearance 24B forming the restricted flow path for fuel from the chamber 24A there may be provided as shown in dotted outline, a passage 24C incorporating a restrictor.

Moreover, the fuel control device 17 may be arranged to produce in the pipeline 18 a fuel pressure which increases towards the output pressure of the pump 13 as the amount of fuel supplied to the associated engine is increased. In this case the pressures applied to the piston 43 are reversed and the passage 50 is connected to the pipeline 18 and the passage 46 is connected to the interior of the body part. This arrangement has the advantage over the illustrated example that the stress in the spring 44 is reduced.

The provision of the damping chamber reduces the movement of the piston 21 due to cam reaction particularly when the followers move over the crests of the cam lobes and thereby the position of the piston 21 and cam ring can be more precisely controlled. In addition the fact that the valve member 29 is no longer subject to the control pressure for the purpose of controlling its position but is positioned by the larger pistons 41, 43, also enhances the control of the position of the piston 21 and the cam ring.

Figure 2:
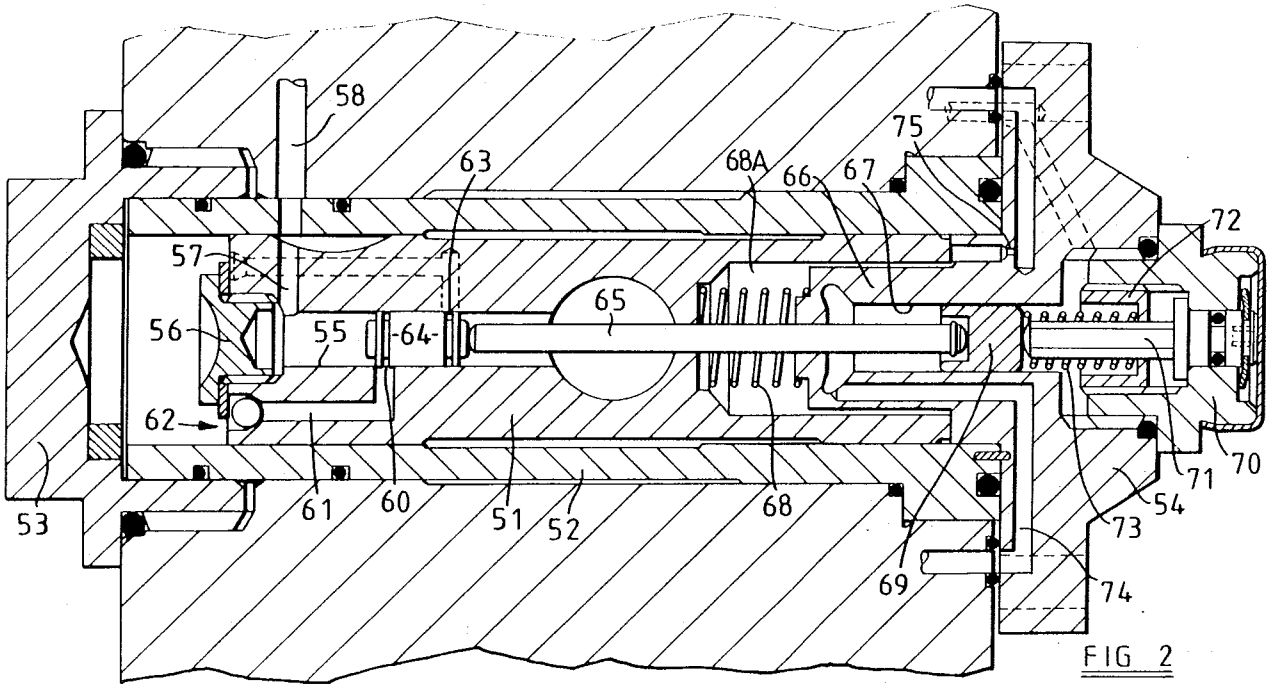

In FIG. 2 there is shown a modified form of pump in which a piston 51 is slidably mounted within a cylinder formed by a sleeve 52 secured within the body part of the pump by a plug 53 at one end and an end closure 54 at the opposite end. The piston 51 is provided with the central opening as in the example shown in FIG. 1 and is also provided with a bore 55 which extends from the opening to the end of the piston adjacent the plug. This end of the bore 55 is closed by a screwed plug 56 and is in communication with the outlet 16 of the low pressure pump 13 by way of a passage 57 in the piston which is in constant communication with a passage 58 in the body which is connected to the outlet 16. Opening into the bore 55 is a port 60 which is connected to the adjacent end of the cylinder defined by the sleeve by means of a passage 61 containing a ball check valve 62. Also opening into the bore 55 is a further port 63 which is spaced from the port 60 and is connected with the adjacent end of the cylinder by a further passage in the piston. Slidable in the bore is a valve member 64 which in an equilibrium position can just cover both ports 60, 63.

Engaged with the valve member is a pin 65 which is slidable within an aperture in the piston and which is also slidable in an aperture formed in a cylindrical portion 66 of the end closure 54. The piston is recessed to accommodate the cylindrical portion and the latter is provided with a stepped bore 67 into the narrower part of which the pin extends. The piston 51 is biased by a spring 68 interposed between the piston and the extension and slidable in the narrower part of the bore 67 is a control piston 69 which is engaged by the pin. The larger end of the bore 67 is closed by a plug 70 which mounts an angularly movable stop member 71, the latter limiting the extent of movement of the piston 69 and the valve member 64. The stop member is splined and it passes through a complementarily shaped hole formed in the base wall of a cup-shaped member. The cup-shaped member 72 is provided with a screw threaded outer surface the threads being engaged with complementary threads on the plug 70 whereby as the stop member is rotated the axial position of the cup-shaped member 72 will vary. Interposed between the piston 69 and the cup-shaped member is a spring 73 which biases the piston 69, the pin 65 and the valve member 64 against the pressure of fuel in the bore 55.

The narrower portion of the bore 67 is in communication with the interior of the body part of the pump by way of a passage 74 and the space 68A defined between the piston 51 and the cylindrical portion 66 also communicates with the interior of the body part by way of a restrictor 75 which forms a restricted flow path for the flow of fuel from the space. Finally the face of the piston 69 which is presented to the stop member 71 is exposed to the pressure developed by the control device 17 in this case, the pressure increasing towards the output pressure of the low pressure pump as the amount of fuel supplied to the associated engine is increased.

In FIG. 2, the valve member 64 is in its extreme right position but at lower engine speeds as the output pressure of the low pressure pump increases as the speed of the associated engine increases, the valve member 64 which is subjected to the output pressure of the low pressure pump, will move towards the right against the action of the spring 73, to uncover the port 60 to allow fuel into the cylinder, the fuel moving the piston 51 towards the right until the part 60 is covered. The movement of the valve member is against the action of the spring 73 the force exerted by which can be altered by rotation of the stop member. The pressure generated by the control device 17 assists the action of the spring 73 which in the event of a fall in the output pressure of the pump will move the valve member to the left to uncover the port 63 thereby to allow fuel to flow from the cylinder. The piston 51 will follow the movement of the valve member 64 due to the action of the spring 68 and also the reaction imparted to the cam when the followers engage the leading flanks of the cam lobes.

As in the previous example movement of the piston due to reaction forces developed as the cam followers are engaged with the leading flanks of the cam lobes is prevented once the port 63 has been closed, by the valve 62 and the movement of the piston in the opposite direction is damped by the restriction to the flow of fuel offered by the restrictor 75.

Compared with the previous example the damping of the movement of the piston is the same. However, the positioning of the valve member 64 is less precise because the opposite ends of the valve member are exposed to different fuel pressures and is therefore liable to be influenced by any pressure variations in the body part of the pump and also because the areas of the valve member and piston 69 exposed to the fuel pressures are smaller.

I claim:

1. A fuel injection pump for supplying fuel to an internal combustion engine comprising a pumping plunger located in a plunger bore, cam means and a cam follower means, a drive shaft coupled to one of said means for driving the cam means and cam follower means relative to each other to impart inward movement to the plunger, a fluid pressure operable device for effecting limited movement of the other of said means about the axis of rotation of the drive shaft, said device comprising a piston slidable within a cylinder, means coupling the piston to the other of said means, a control valve member slidable within a bore defined in the piston, passage means through which the opposite ends of said control valve member are exposed to a low pressure, port means opening into said bore and controlled by the valve member whereby when the valve member is moved in one direction fluid can flow to one end of the cylinder to move the piston in the same direction to re-establish an equilibrium position and when the valve member is moved in the other direction fluid can flow out of said one end of the cylinder to allow the piston to move in the other direction until the equilibrium position is re-established, and means responsive to a control pressure for controlling the position of said valve member.

2. A pump according to claim 1 in which said port means comprises first and second axially spaced ports opening into the bore defined in the piston, said ports being connected by first and second passages to said one end of the cylinder, said valve member including a land which in an equilibirum position covers both said ports, and which when the valve member is moved away from said one end of the cylinder uncovers the first port to allow fluid under pressure to flow into said one end of the cylinder and which when the valve member is moved towards said one end of the cylinder uncovers the second port to allow fluid to escape from said one end of the cylinder, said first passage incorporating a non-return valve to prevent escape of fluid from said one end of the cylinder when the piston is urged by external forces towards said one end of the cylinder, and means for damping the movement of the piston away from said one end of the cylinder.

3. A pump according to claim 2 in which said damping means includes a space in part defined by the piston and a restricted flow path in communication with said space, the movement of the piston away from said one end of the cylinder being damped by the restriction to the flow of liquid along said flow path.

4. A pump according to claim 2 including an end closure for the other end of the cylinder, the piston and the other end of the cylinder defining a space which diminishes in volume as the piston moves towards the other end of the cylinder and a restricted flow path in communication with said space.

5. A pump according to claim 4 in which said restricted flow path is defined by a passage in said end closure and a restrictor in said passage.

6. A pump according to claim 4 in which said restricted flow path is at least in part defined by a restrictor formed in a passage in the piston.

7. A fuel injection pump for supplying fuel to an internal combustion engine comprising a pumping plunger located in a plunger bore, cam means and a cam follower means, a drive shaft coupled to one of said means for driving the cam means and cam follower means relative to each other to impart inward movement to the plunger, a fluid pressure operable device for effecting limited movement of the other of said means about the axis of rotation of the drive shaft, said device comprising a piston slidable within a cylinder, means coupling the piston to the other of said means, a control valve member slidable within a bore defined in the piston, passage means through which the opposite ends of said control valve member are exposed to a low pressure, port means opening into said bore and controlled by the valve member whereby when the valve member is moved in one direction fluid can flow to one end of the cylinder to move the piston in the same direction to re-establish an equilibrium position and when the valve member is moved in the other direction fluid can flow out of said one end of the cylinder to allow the piston to move in the other direction until the equilibrium position is re-established, and means responsive to a control pressure for controlling the position of said valve member, in which the means responsive to a control pressure comprises first and second control pistons housed in a stepped bore, the first piston being smaller in diameter than the second piston and being engaged therewith, resilient means biasing the control pistons towards said one end of the cylinder, a pin extending between said valve member and said first piston, first passage means through which liquid at a pressure which varies in accordance with the speed at which the pump is driven is applied to the first control piston in opposition to the force exerted by the resilient means, and second passage means through which liquid at a pressure which varies depending on the amount of fuel supplied by the pump to the associated engine, is applied to the second control piston.

8. A pump according to claim 7 in which the liquid pressure varies inversely to the amount of fuel supplied to the engine and the liquid pressure acts upon the second control piston in opposition to the force exerted by the resilient means.

9. A pump according to claim 7 in which said stepped bore is concentric with said cylinder said pin extending through said space and with limited clearance through an aperture in said first mentioned piston to engage said valve member, and resilient means biasing the valve member into engagement with said pin, said pin and said aperture defining said restricted flow path.

10. A pump according to claim 7 including further means interposed between the pin and said first control piston for limiting compressive stress in the pin.

11. A pump according to claim 7 in which the liquid pressure increases as the amount of fuel supplied to the associated engine increases and the liquid pressure acts upon the second control piston to assist the action of the resilient means.

12. A pump according to claim 11 in which said further means comprises an abutment slidably accommodated in a recess in the first control piston, said abutment being engaged by the pin, and a preloaded spring interposed between the abutment and the piston.

* * * * *